US010528007B2

(12) United States Patent
Luke, Jr.

(10) Patent No.: US 10,528,007 B2
(45) Date of Patent: Jan. 7, 2020

(54) WATCH BAND INSERT FOR POSITIONING WATCH FACE ON THE INTERIOR SIDE OF A PERSON'S FOREARM

(71) Applicant: John Luke, Jr., Kitty Hawk, NC (US)

(72) Inventor: John Luke, Jr., Kitty Hawk, NC (US)

( * ) Notice: Subject to any disclaimer, the term of this patent is extended or adjusted under 35 U.S.C. 154(b) by 26 days.

(21) Appl. No.: 15/875,137

(22) Filed: Jan. 19, 2018

(65) Prior Publication Data

US 2018/0210399 A1 Jul. 26, 2018

Related U.S. Application Data

(60) Provisional application No. 62/449,644, filed on Jan. 24, 2017.

(51) Int. Cl.
*G04B 37/14* (2006.01)
*G04B 47/06* (2006.01)

(52) U.S. Cl.
CPC ..... *G04B 37/1486* (2013.01); *G04B 47/063* (2013.01)

(58) Field of Classification Search
CPC ..... G04B 37/1486; G04B 47/063; G04G 21/025; A44C 5/00; A44C 5/12; A44C 5/14; A44C 5/145
USPC ..... 224/164, 171, 179, 180, 174; 368/281, 368/286, 282; D10/32
See application file for complete search history.

(56) References Cited

U.S. PATENT DOCUMENTS 2,745,580 A * 5/1956 Ward ..... G04B 37/005 224/171
5,068,840 A * 11/1991 Buckner ..... A44C 5/00 224/171
9,632,534 B1 * 4/2017 Devaney ..... G06F 1/163

* cited by examiner

*Primary Examiner* — Nathan J Newhouse
*Assistant Examiner* — Matthew T Theis
(74) *Attorney, Agent, or Firm* — Coats & Bennett, PLLC

(57) ABSTRACT

An insert for a watch that enables the wrist watch to be positioned on the forearm of a person such that the main body and face of the wrist watch is disposed adjacent an inner side or edge of the forearm in a convenient line of sight for the person wearing the wrist watch. The insert includes a web and a pair of flanges extending from the web. The insert is designed to be attached to the watch such that the web and flanges form an interface between the wrist watch and a person's forearm for securely stationing the main body and face of the watch on the inner side or edge of the forearm.

3 Claims, 6 Drawing Sheets

WATCH BAND INSERT FOR POSITIONING WATCH FACE ON THE INTERIOR SIDE OF A PERSON'S FOREARM

FIELD OF THE INVENTION

The present invention relates to accessories for wrist watches and more particularly to an accessory for a running watch that positions the face of the running watch adjacent the inner side or edge of the forearm.

BACKGROUND

Running watches vary from the simplistic to the relatively sophisticated. In either case, running watches provide a runner with valuable information such as, for example, time elapsed, distance covered, speed, distance splits, biometric information, and even position based on GPS data. The problem faced by a runner is not having access to this information but rather the problem relates to the inconvenience and difficulties in quickly and clearly discerning the information being provided by the running watch. It is not uncommon to see a runner repeatedly lifting the forearm bearing the running watch and rotating the forearm so that he or she can see the data or information being displayed on the watch face. Over a significant distance, this amounts to a lot of forearm lifting and rotating, not to mention the difficulties of quickly and clearly reading and comprehending the data and information being furnished on the watch face. This is all because the face of the watch is not located in the normal line of sight of the runner. Running watches, like conventional wrist watches, are designed for the main body of the watch to be positioned and disposed on the upper surface of the forearm. In a running configuration, the upper surface of the forearm is normally inclined outwardly. This is why we see runners continuously lifting the forearm bearing the watch and rotating the forearm and watch clockwise so that the data and information on the face of the watch can be quickly and easily discerned.

Therefore, there has been and continues to be a need for a device that enables the face of the running watch to be located about the forearm in a convenient location which obviates the need for the continuous rotation of the forearm by the runner to discern information being communicated by the running watch.

SUMMARY OF THE INVENTION

The present invention relates to an insert that is coupled to a running watch and forms an interface between the main body of the watch and the person's forearm which enables the main body of the watch to be securely positioned and held on the inner side or edge of the forearm in a convenient line of sight for the person wearing the watch.

In one particular embodiment, the present invention includes an insert that includes a web and a pair of flanges extending from the web. The flanges include openings for enabling watch band segments to be inserted therethrough. This enables the main body of the watch to be disposed on the outer surface of the insert while the band segments extend along outer surfaces of the flanges and into and through the openings in terminal end portions of the flanges. When the band segments are fastened, the flanges extend in general parallel relationship across the upper and lower surfaces of the forearm such that the main body of the watch is disposed adjacent the inner edge or side of the forearm where the face of the watch is easily seen by the person wearing the insert and watch.

Other objects and advantages of the present invention will become apparent and obvious from a study of the following description and the accompanying drawings which are merely illustrative of such invention.

DESCRIPTION OF EXEMPLARY EMBODIMENT

Figure 1:
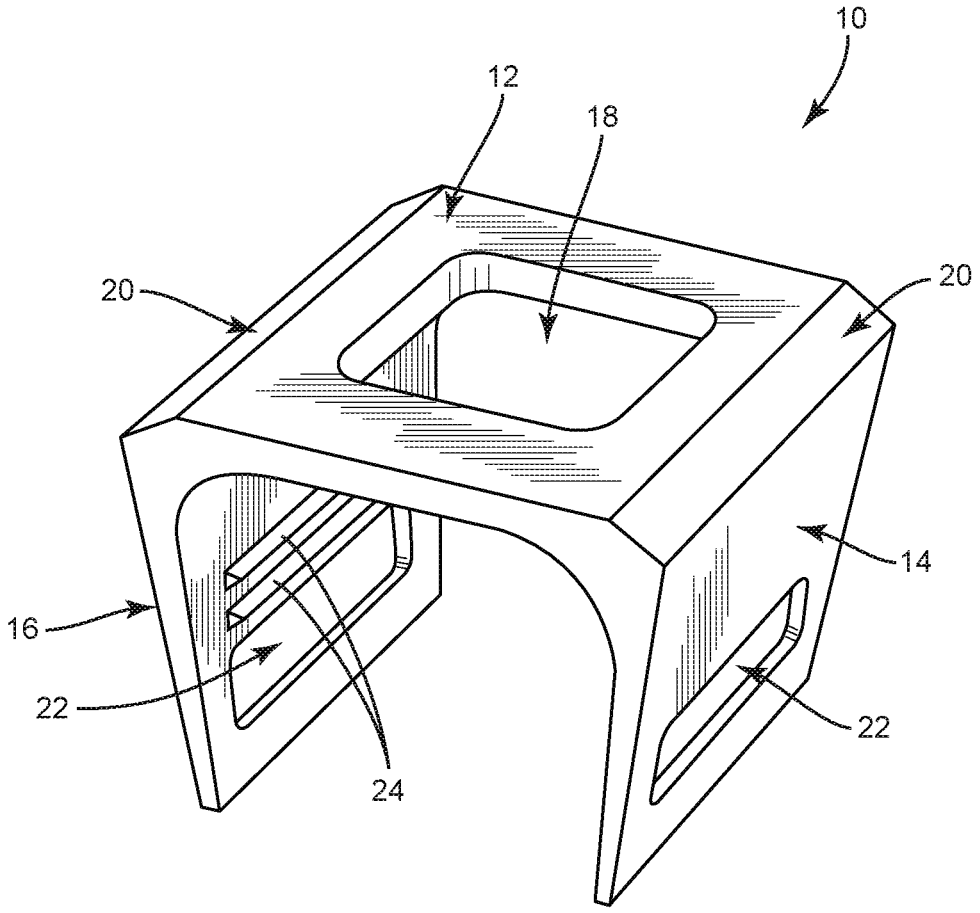
FIG. 1 is a perspective view of the watch band insert.
Figure 2:
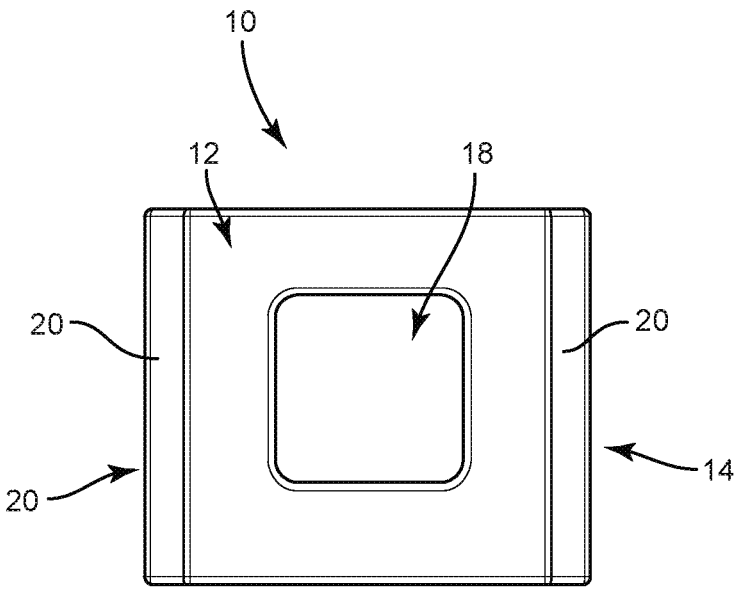
FIG. 2 is a top plan view of the insert.
Figure 3:
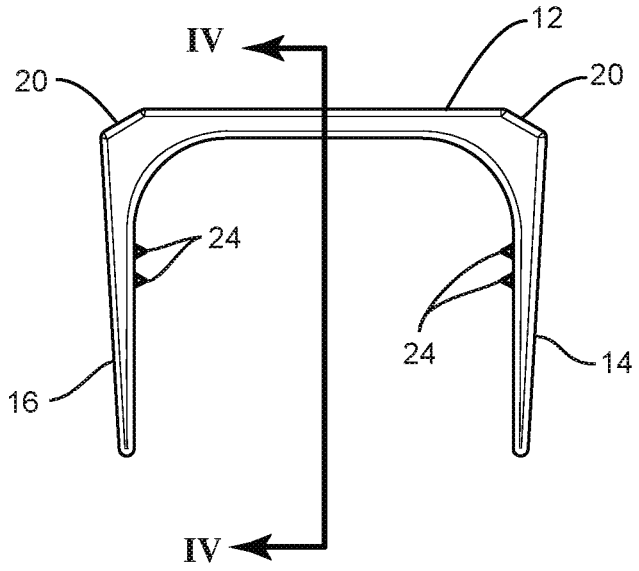
FIG. 3 is an end elevational view of the insert.
Figure 4:
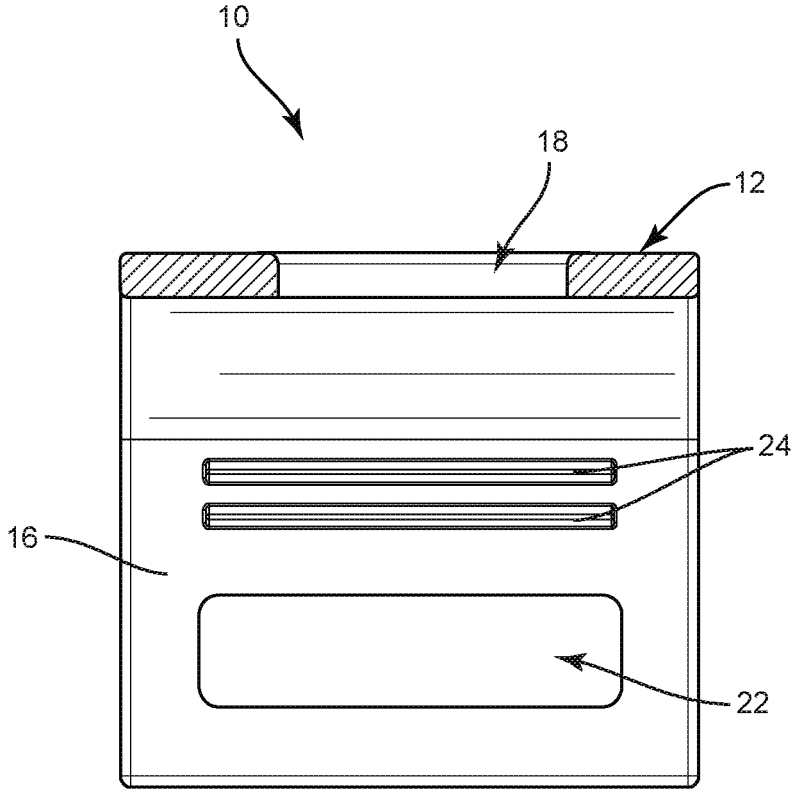
FIG. 4 is a sectional view taken through the line IV-IV of FIG. 3.

With further reference to the drawings, particularly FIG. 1, the insert or interface of the present invention is shown therein and indicated generally by the numeral 10. The terms "insert" and "interface" are used interchangeably herein. Insert 10 can be constructed of various materials. In some embodiments, the insert 10 can be constructed of at least slightly pliable plastic or rubber material such that the insert can easily conform to a person's forearm.

Viewing the insert 10 in more detail, the same comprises a web or pad 12 and a pair of flanges or extensions 14 and 16 that extend from the web 12. Note the barbs 24 disposed on the inner surface of the flanges 14 and 16. The barbs 24 hold the insert or interface 10 in place by compressing slightly into the skin of the forearm. Together the web 12 and flanges 14 and 16 form a generally U-shaped structure that, as described below, is designed to form an interface between the forearm and a watch and to position the face or main body 50 of the watch 100 adjacent the inner side or edge of the forearm (See FIGS. 6 and 7) in a convenient line of sight of the person wearing the watch. In some cases, the web is referred to as a pad and the flanges are referred to as extensions.

Web 12 includes an outer surface for engaging and supporting the back of the watch. The outer surface of the web 12 can assume various shapes and configurations. In the exemplary embodiment shown herein, the outer surface of the web 12 assumes a generally square or rectangular configuration. An opening 18 is provided in the web 12. This permits biometric data or information to be communicated from a person's arm to the main body (or housing) of the watch. On each side of the web 12, there is provided a beveled transition edge 20. As seen in FIG. 1, the transition edge 20 forms a transition between the outer surface of the web 12 and the flanges 14 and 16.

Formed about a terminal end portion of the flanges 14 and 16 is a band opening 22. Band openings 22 enable the two segments of a watch band to be threaded therethrough effectively coupling the insert 10 to the watch. As is appreciated from the drawings, the insert 10 effectively forms a saddle that underlies the main body 50 of the watch 100 and portions of the band segments 54, 56 that extend therefrom. See FIG. 5. The term "main housing" or "main body", as used herein, refers to the housing disposed between the band segments and which houses the inner workings and mechanisms of the watch 100. Effectively, substantial portions of the watch 100 are mounted about the exterior of the insert 10.

In order to use the insert or interface 10 of the present invention, the watch 100 is placed over the exterior of the insert 10 and one segment 54 of the band is inserted through one band opening 22 on one of the flanges and the other band segment 56 is inserted through the other band opening 22 in the other flange. The main body 50 of the watch 100 is positioned over the exterior surface of the web or pad 12. That is, the back of the main body 50 is aligned with the opening 18 and securely supported about the outer surface of the web 12. This means that the face 52 of the watch 100 lies generally parallel with the web 12. The band segments 54, 56 extend from the main body 50 of the watch 100 adjacent the exterior surfaces of the flanges 14 and 16 and, as noted above, a portion of the segments extend through the band openings 22.

Figure 6:
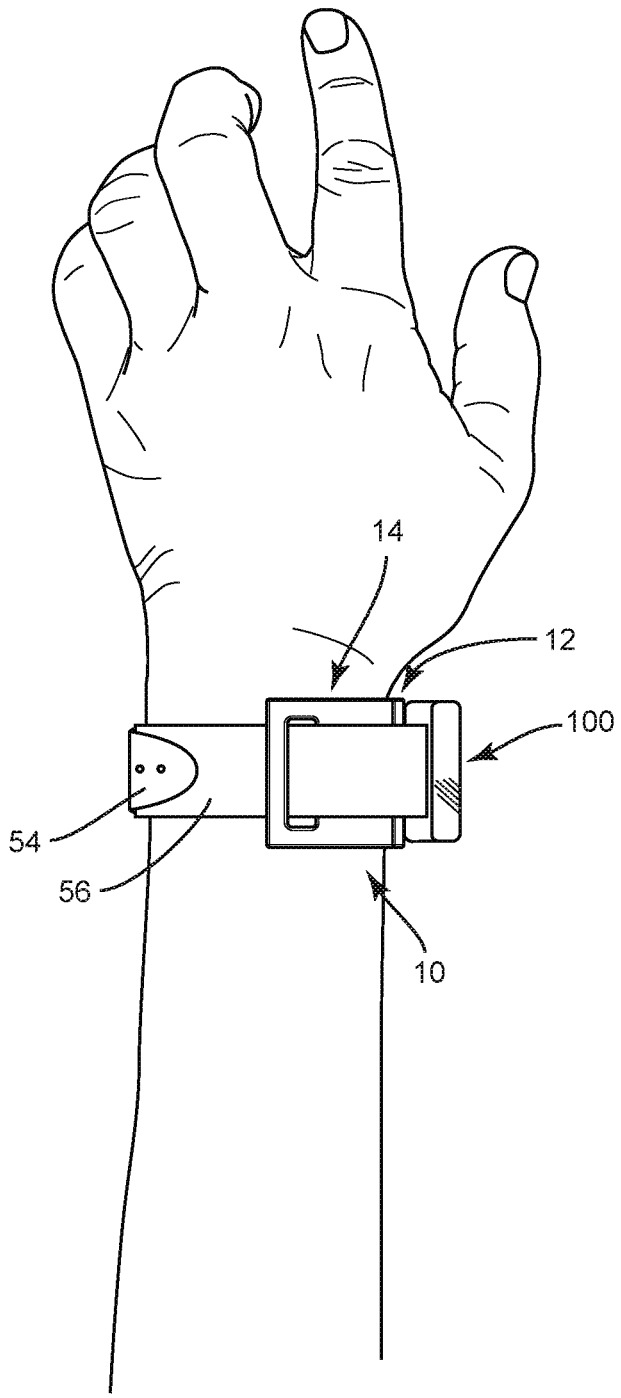
FIG. 6 is a view illustrating the insert attached to the forearm of a person.
Figure 7:
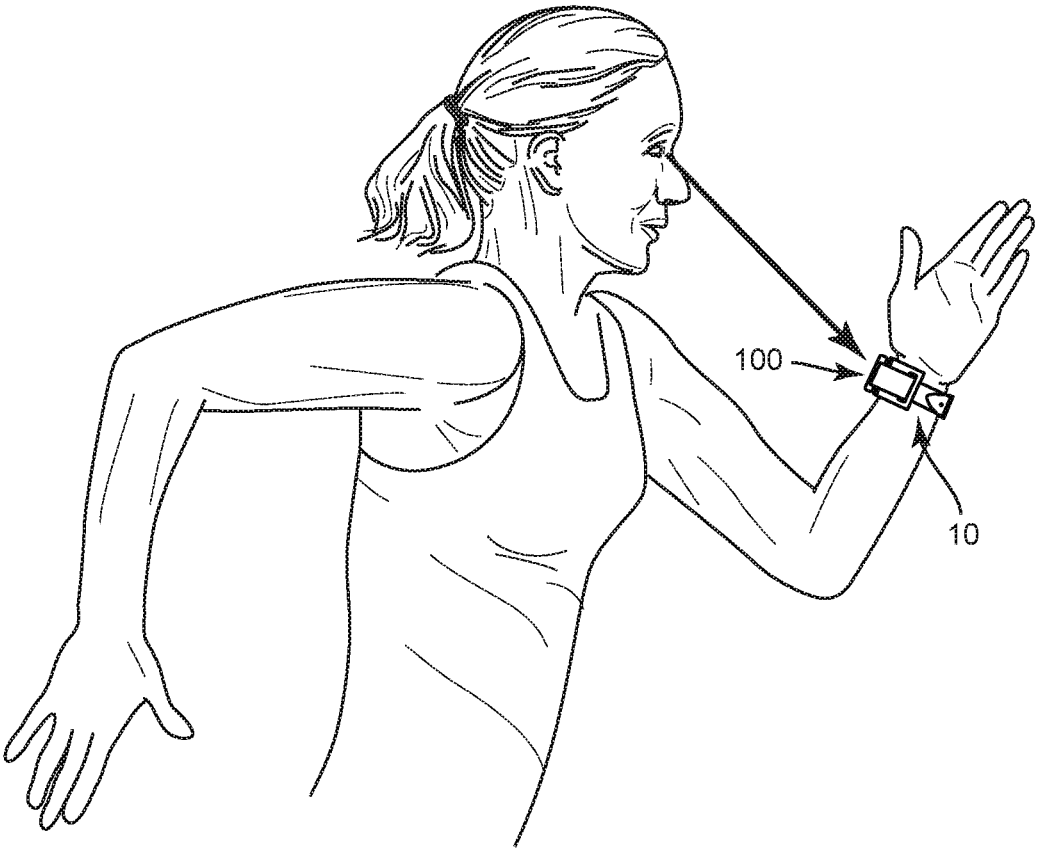
FIG. 7 is a perspective view of a runner wearing the insert and associated watch and showing the main body of the watch being disposed in the runner's line of sight.

Insert 10 and the watch 100 are then positioned on the forearm as shown in FIGS. 6 and 7. That is, the insert 10 is positioned about the forearm such that the main body 50 of the watch 100 is side mounted to the forearm. In this configuration, one of the flanges 14 or 16 extends across an upper surface of the forearm and the other one of the flanges 14 or 16 extends across the bottom or lower surface of the forearm. Thus, the web 12 is positioned over and engages the inner edge or side of the forearm. See FIGS. 6 and 7. Once the two band segments are fastened together and appropriately tensioned, this results in the insert 10 conforming and adhering to the forearm in this configuration. It also results in the face 52 of the watch being disposed in a line of sight that enables the person wearing the insert 10 and watch 100 to easily see and read information and data displayed on the face of the watch. That is, in most natural positions assumed by the forearm, while running, the information and data being displayed on the face of the watch can be easily seen and discerned without the person having to rotate the forearm so that the face of the watch is in a convenient line of sight.

The design of the insert 10 enables the insert to be held on the forearm with the web securely held around at least a portion of the inner edge of the forearm. Indeed, the inner surface of the web can be arcuate shaped or slightly concave to at least slightly conform to the shape of the inner edge of the forearm. Furthermore, the flanges 14 and 16 extending across the upper and lower surfaces of the forearm tend to stabilize the web in place adjacent the inner edge of the forearm. Once the insert 10 is coupled to the watch 100 and fastened about the forearm of a person, it follows that the watch is securely held about the insert and that substantial relative movement between the two is prevented. The tensioning of the watch band tends to clamp and compress the insert to the arm and this plays a role in securing the main body and face of the watch to the inner edge or side of the forearm. Thus, in the case of a running application, the runner typically swings his or her arms at least slightly back and forth and the forearm carrying the watch 100 tends to be disposed at an angle such that the inner edge or side of the forearm tends to face the line of slight of the runner.

Figure 5:
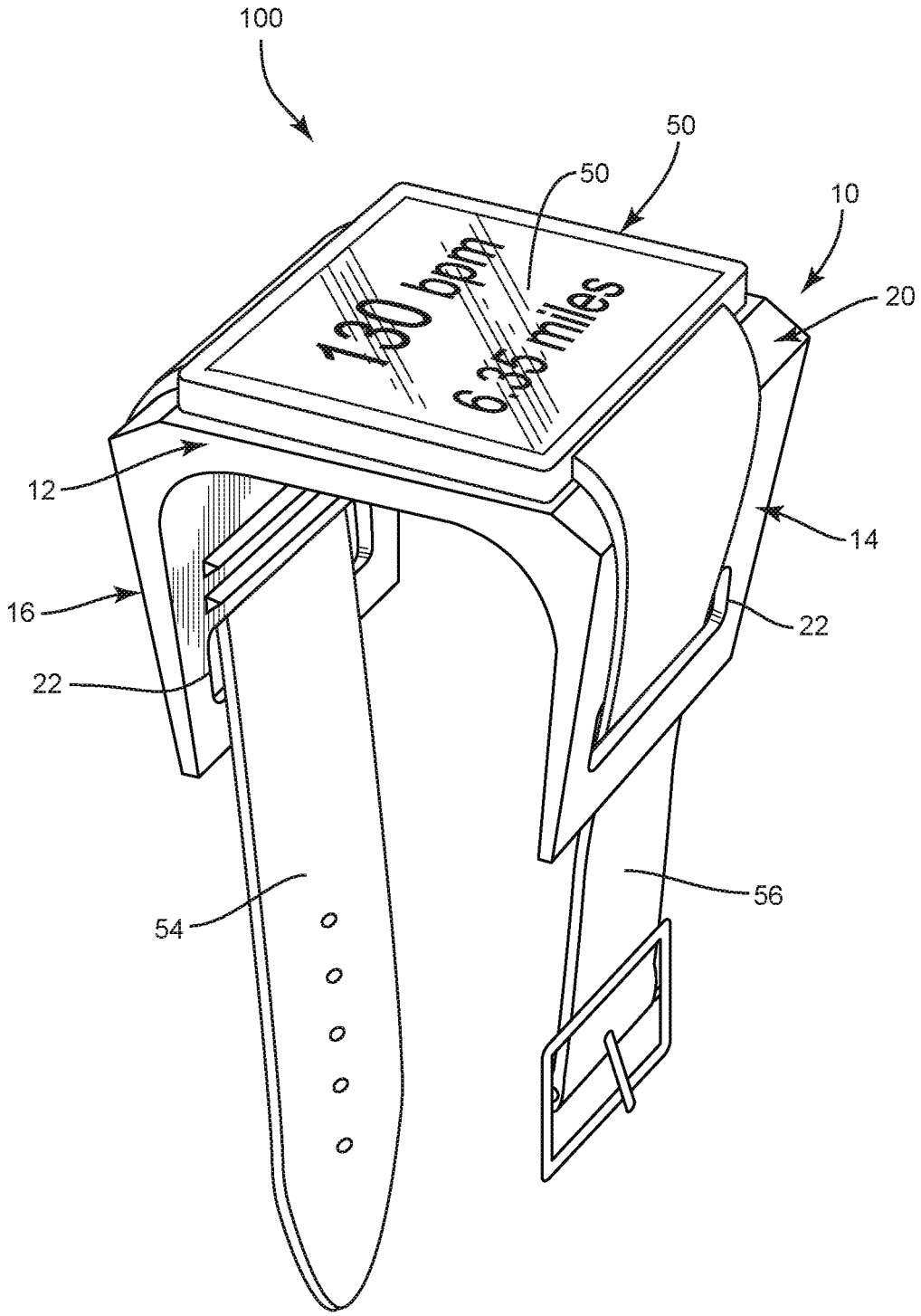
FIG. 5 is a perspective view of a combination insert and watch wherein the watch is secured to the insert.

From a study of the present specification and the drawings, it is appreciated that there are several embodiments of the present invention. One embodiment includes the insert or interface 10 shown in FIGS. 1-4. In describing this embodiment, reference has been made to a watch for the purpose of giving context to the insert or interface 10 shown in FIGS. 1-4. A second embodiment is shown in FIG. 5. This embodiment comprises a combination. The combination is made up of the insert or interface 10 and a watch and, in certain cases, this combination has been specifically claimed.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A combination watch and insert comprising:

the insert including a web and a pair of flanges extending from the web, the flanges having terminal ends;

the insert assuming a generally U-shape and constructed of a pliable material;

wherein the flanges are flexible and configured to flex back and forth with respect to the web and including band openings formed therein;

a plurality of barbs disposed on inner surfaces of the flanges between the band openings and the web;

wherein there is a gap defined between the terminal ends of the flanges that enables a forearm of a person to be inserted through the gap and into a space defined by the flanges and the web;

the watch including a main body and a pair of bands extending from the main body;

the main body of the watch contacts and engages an upper surface of the web and is supported on the web;

the pair of bands extending from opposite sides of the main body of the watch and contacting and engaging outer surfaces of the flanges;

the bands extending along the outer surfaces of the flanges and threaded through the band openings formed in the flanges; and wherein the insert supporting the main body of the watch is configured to be positioned on an inner side or edge of the person's forearm.

2. The combination watch and insert of claim 1 wherein the web includes an opening formed completely through the web and configured to permit biometric data to be accessed by the main body of the watch.

3. The combination watch and insert of claim 1 comprising the plurality of barbs disposed on inner surfaces of the flanges between the band openings and the web; and wherein the web includes an opening formed completely through the web and configured to permit biometric data to be assessed by the main body of the watch.

* * * * *